US005713773A

United States Patent [19]

Churchill

[11] Patent Number: 5,713,773

[45] Date of Patent: Feb. 3, 1998

[54] MOUNTABLE TOWED WATER CRAFT

[75] Inventor: Robert Lee Churchill, Redlands, Calif.

[73] Assignee: SwimWays Corporation, Virginia Beach, Va.

[21] Appl. No.: 715,867

[22] Filed: Sep. 19, 1996

[51] Int. Cl.[6] ..... B63B 1/00

[52] U.S. Cl. ..... 441/66; 114/345

[58] Field of Search ..... 441/65, 66, 130, 441/131, 132, 129; 472/128, 129; 114/345, 363, 253, 254; D21/228; D12/300, 307, 316

[56] References Cited

U.S. PATENT DOCUMENTS

| | | | |
|---|---|---|---|
| D. 300,840 | 4/1989 | Minurri | D21/228 |
| 2,327,794 | 8/1943 | Hurt . | |
| 2,986,751 | 6/1961 | Baren . | |
| 3,455,571 | 7/1969 | Dallera . | |
| 4,807,554 | 2/1989 | Chi-Hung . | |
| 5,076,189 | 12/1991 | Jones . | |
| 5,362,269 | 11/1994 | Leach . | |
| 5,367,974 | 11/1994 | Moraga et al. | 114/345 |
| 5,447,459 | 9/1995 | Hammond . | |
| 5,472,362 | 12/1995 | Dandurand . | |
| 5,503,099 | 4/1996 | Peterson . | |

FOREIGN PATENT DOCUMENTS

| | | | |
|---|---|---|---|
| 1582802 | 10/1969 | France | 114/345 |
| 393959 | 11/1965 | Switzerland | 441/66 |

*Primary Examiner*—Edwin L. Swinehart
*Attorney, Agent, or Firm*—John F. Carroll, IV

[57] ABSTRACT

A mountable, towable water craft has a single-chambered, inflatable body. The inflatable body includes a full and an upper surface attached to the hull. The hull has a bulge for increasing low speed planing. The upper surface has an aft portion that forms two longitudinal and substantially parallel wells. A cowling is attached to the upper of surface of the inflatable body. The cowling includes reinforceably attached handles, and the inflatable body includes reinforceably attached rope connectors. The vehicle also includes an optional tear-resistant fabric shell.

19 Claims, 5 Drawing Sheets

MOUNTABLE TOWED WATER CRAFT

BACKGROUND

This invention relates to inflatable recreational vehicles designed to be towed behind motorized water craft. More particularly, the present invention concerns an inflatable, towed water craft that is also mountable by passengers.

Outdoor enthusiasts often use motorized water craft in combination with other devices to provide various forms of recreation. Many of these devices, such as water skis, kneeboards and the present invention, are designed to transport a passenger while being towed behind motorized water craft. In particular, water skis and kneeboards are known to be highly maneuverable and therefore demand agility and skill of their users. On the other hand, inflatable water craft are immensely popular because they are affordable, require little expertise to use and can be deflated and stored compactly after use. However, it is commonly known that inflatable water craft that are designed to be towed behind motorized water craft have limited maneuverability.

Common designs of inflatable, towed water craft include inflatable rings and rafts, both of which a rider lies upon rather than mounts. Additionally, it is common that these rings and rafts are towed at only one or two attachment points. These typical raft-styled or ring-styled towed water craft have several inherent performance limitations. Most significantly, the prone riding posture decreases maneuverability. Also, these devices are incapable at planing at low speeds due to their hull designs and lack of structural rigidity. This results in large amounts of low-speed drag, which causes excessive inefficiencies in the towing craft and poor maneuverability for the towed craft. Additionally, when a typical towed water craft capsizes while under tow, the angle at which it is presented to oncoming water often causes negative lift in excess of buoyancy such that the towed vehicle dives downward through the water.

Since inflatable, towed water craft are not typically designed to maximize maneuverability, but rather comfort, ease of use and convenience of storage, they often lack cornering stability which causes them to capsize, particularly during high speed turns. The capsizing of a towed water craft typically occurs when the moment created by a rider's mass, its distance above the water and the centrifugal acceleration produced by a turn, exceeds the moment caused by the rider's mass, the distance from the center of the water craft to the edge contacting the water's surface, and the acceleration of gravity. As would be expected by the lack of cornering stability of common towed water craft, these devices are either quite narrow or require riders to place their body mass in a position relatively high above the surface of the water. These designs substantially decrease cornering stability and thus maneuverability.

As a result, there has been a significant and long felt need for an inflatable, recreational vehicle designed to be mounted and towed behind a motorized water craft. Additionally, there has been a significant and long felt need for an inflatable towed water craft that planes at low speeds and retains structural rigidity at high speeds. Furthermore, there has been a significant need for such a recreational device that is stable and predictably maneuverable, particularly while cornering. Also, a need exists for such a device to resist diving upon capsizing while under tow.

SUMMARY

The present invention is directed toward an inflatable water craft that satisfies the above-mentioned needs. An inflatable water craft having features of the present invention comprises a single-chambered inflatable body with a hull and an upper surface attached to the hull. The upper surface has a fore portion and an aft portion, with the fore portion having a top portion. The aft portion forms a first and a second foot well, which thereby forms in the aft portion of the inflatable body, a middle portion and a first outer portion and a second outer portion. A cowling comprising an inflatable chamber is attached to the top of the fore portion of the upper surface.

These and other features, aspects and advantages of the present invention will become better understood with reference to the following description and appended claims.

DRAWINGS

A preferred embodiment of the present invention will be described in greater detail with reference to the accompanying drawings, wherein like elements bear like reference numerals and where:

DESCRIPTION

Figure 1:
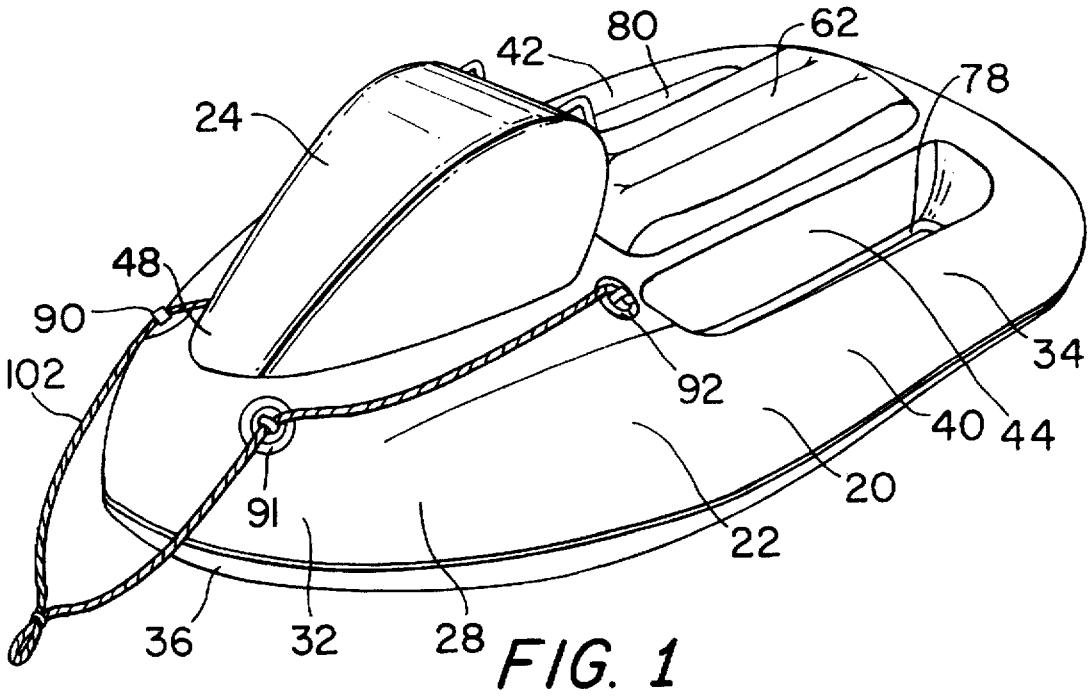
FIG. 1 is a perspective view of a mountable, towed water craft according to an embodiment of the present invention.

Shown in FIG. 1 is an inflatable, towed water craft 20 embodying the present invention. The inflatable, towed water craft 20 is designed to be flexible when not inflated so that it may be easily stored. The craft 20 is also designed with durability adequate to withstand the rigors of storage, inflation, transportation to and from the site of intended use, and towing. The craft 20, therefore, may include inflatable chambers made of suitable material such as polymeric sheeting. The water craft also includes an optional tear-resistant fabric shell 23.

Figure 7:
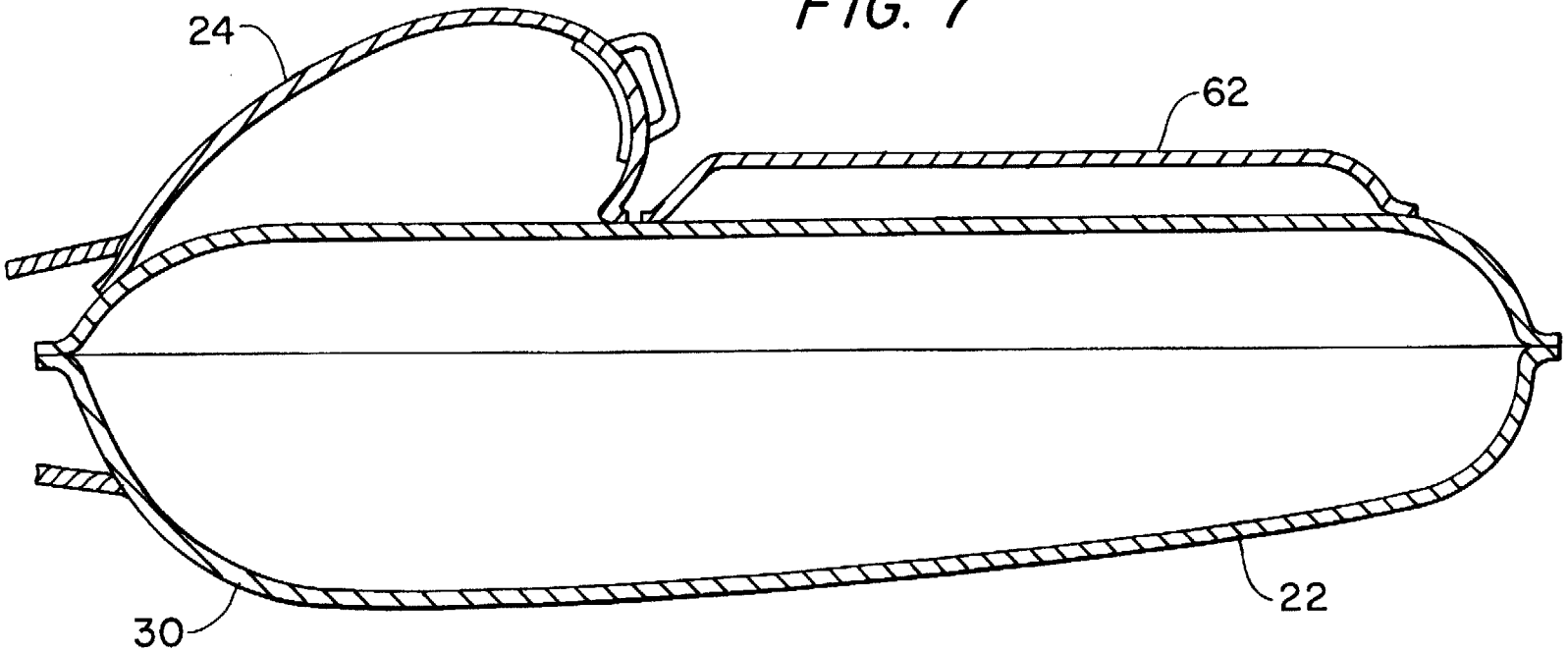
FIG. 7 is a cross-sectional view of the invention of FIG. 1, taken along the sectional line 7—7 in FIG. 3.

The craft 20 includes two primary inflatable chambers, a body 22, and a cowling 24. The body includes a hull 26, best shown in FIG. 4 and an attached upper surface 28, best shown in FIGS. 1–3. As shown in FIGS. 4 and 7, the hull 26 includes a longitudinally centered bulge 30 running along its length, tapered from fore to aft, increasing the pitch at which the craft 20 meets oncoming water, thus increasing the ability of the craft 20 to achieve low-speed planing. Additionally, this longitudinal bulge 30 increases the ability of the craft 20 to resist side-slipping during turns, thus increasing tracking ability.

Figure 2:
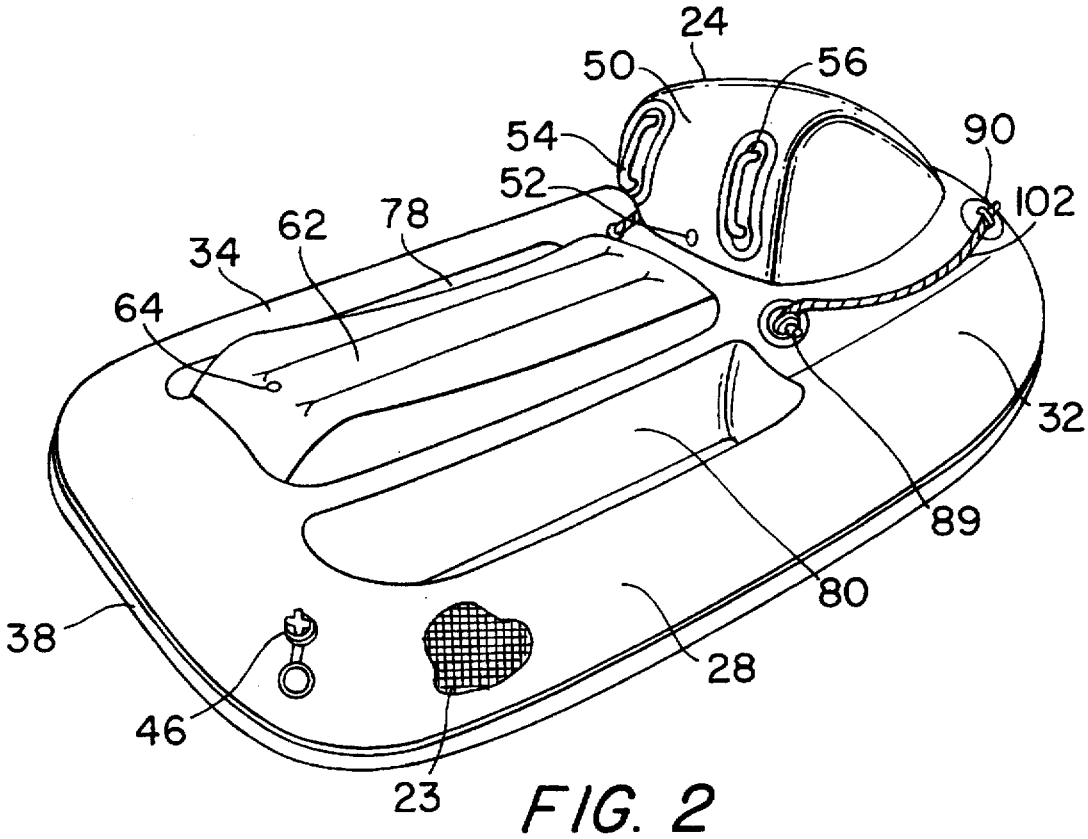
FIG. 2 is a perspective view of the invention of FIG. 1.
Figure 3:
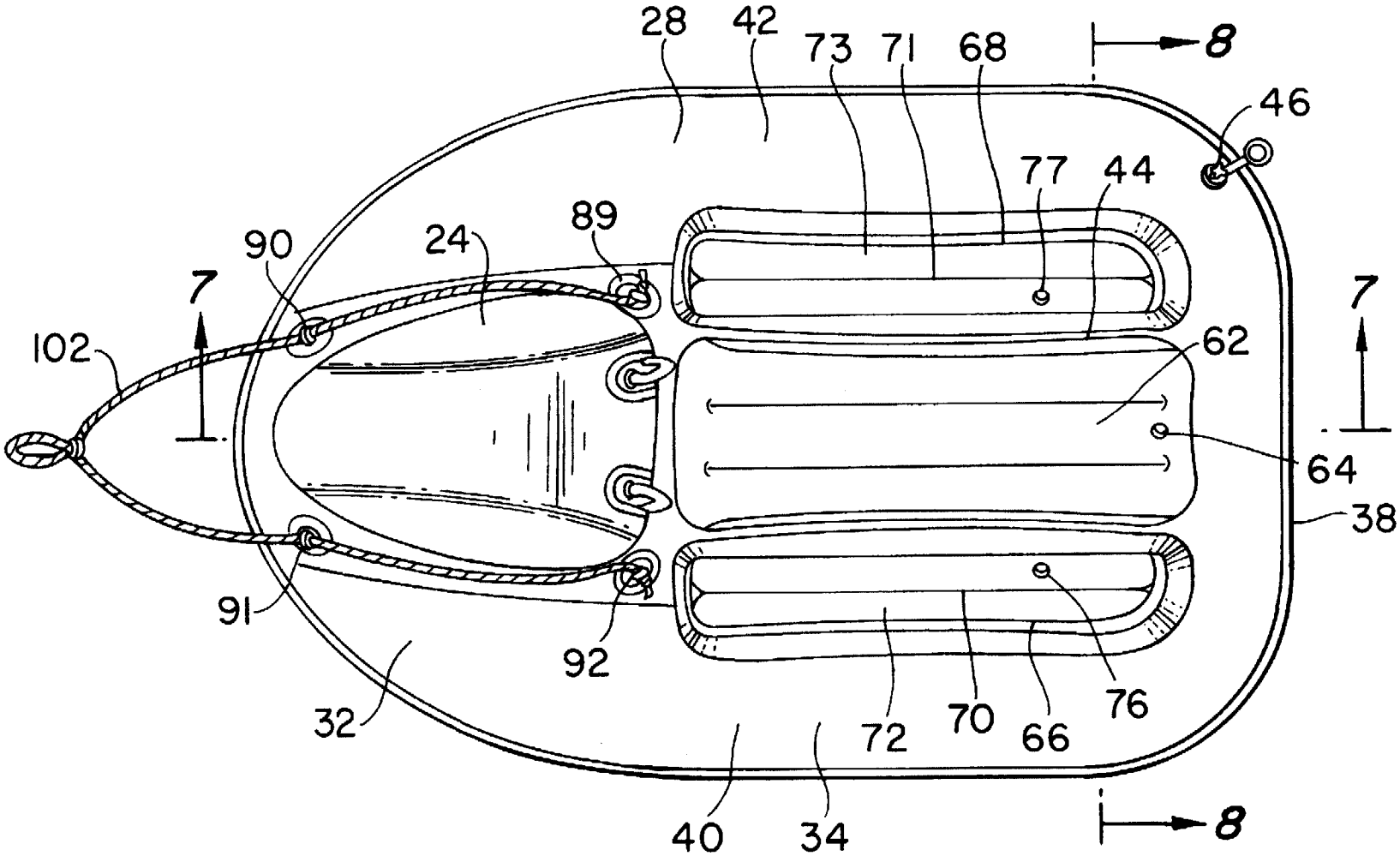
FIG. 3 is a top plan view of the invention of FIG. 1.
Figure 4:
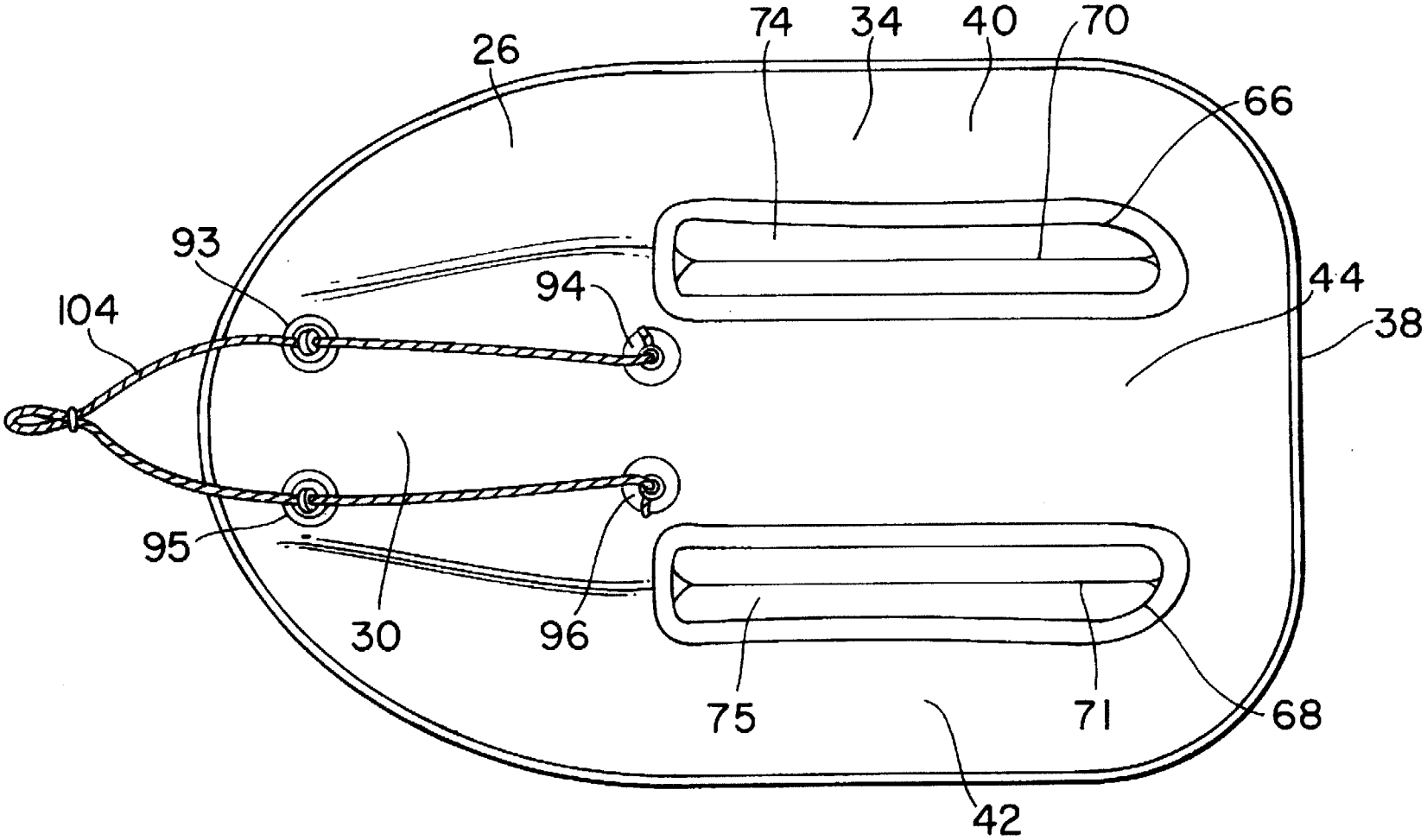
FIG. 4 is a bottom plan view of the invention of FIG. 1.

Together the hull 26 and the upper surface 28 form a fore portion 32 and an aft portion 34, each best shown in FIGS. 1–3. The fore portion 32 includes a bow 36, best shown in FIG. 1, and the aft portion 34 includes a stern 38, best shown in FIGS. 2 and 3. The aft portion 34 of the body 32 further includes a left integrated perimeter inflation tube 40, a right integrated perimeter inflation tube 42 and an integrated middle tube 44, all of these best shown in FIG. 3. Additionally, the body further includes an inflation valve 46.

Figure 5:
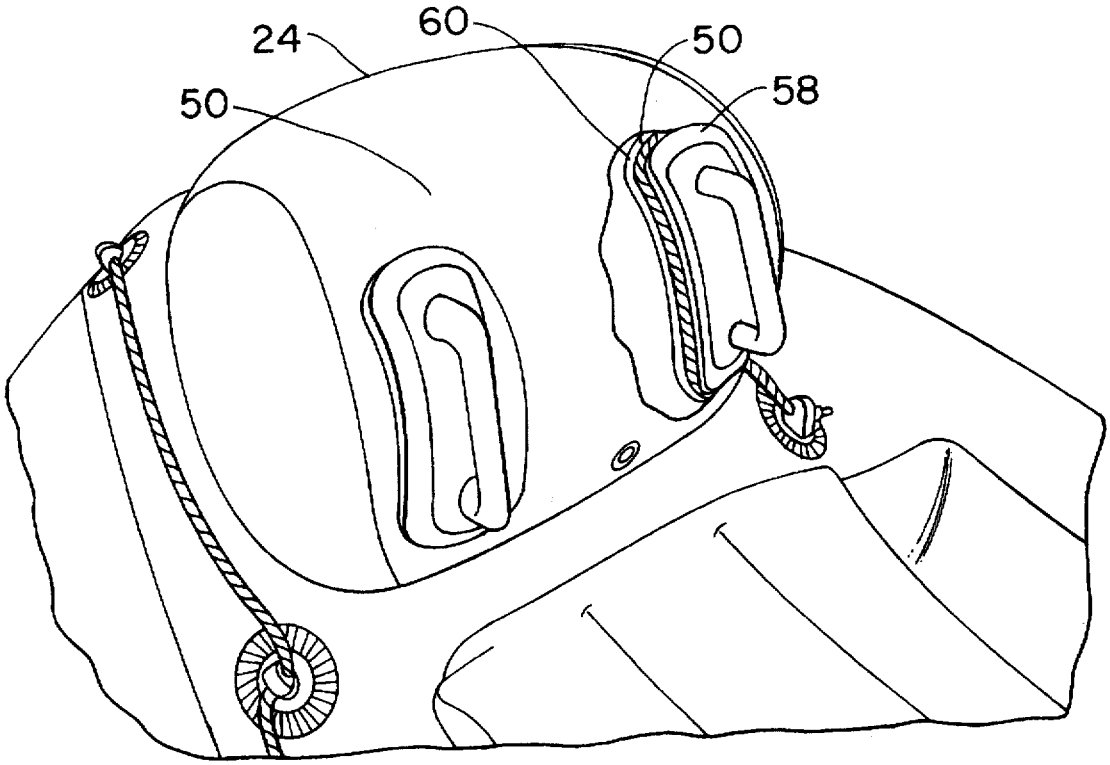
FIG. 5 is a partial and exploded perspective view of the invention of FIG. 1 showing detail of handle construction.

As seen in FIGS. 1 and 2, the cowling 24 is attached to the fore portion 32 of the upper surface 28 of the body 22 and includes a front portion 48 and a rear portion 50. The cowling 24 is tapered from the rear portion 50 to the front portion 48, providing the vehicle 20 with the ability to resist diving upon capsizing while under tow. The cowling 24 also includes an inflation valve 52. Attached to the rear portion 50 of the cowling 24 are a first handle assembly 54 and a second handle assembly 56. As shown in FIG. 5, the handle assemblies 54, 56 each include a handle-mounting base 58 which is attached to the rear portion 50 of the cowling 24 with a reinforcing backing 60 attached immediately interior of the position at which the handle-mounting base 58 is attached to the rear portion 50 of the cowling 24.

As shown in FIGS. 1–4 and 8, the aft portion 34 of the body 22 of the inflatable, towed water craft 20 includes three additional inflatable chambers. A seat 62 formed of an inflatable chamber attached to the middle chamber 44 of the aft portion 34 of the body 22 allows for maximum optimization of height of passenger mass above the water surface. The inflatable chambered seat 62 includes an inflation valve 64.

Figure 8:
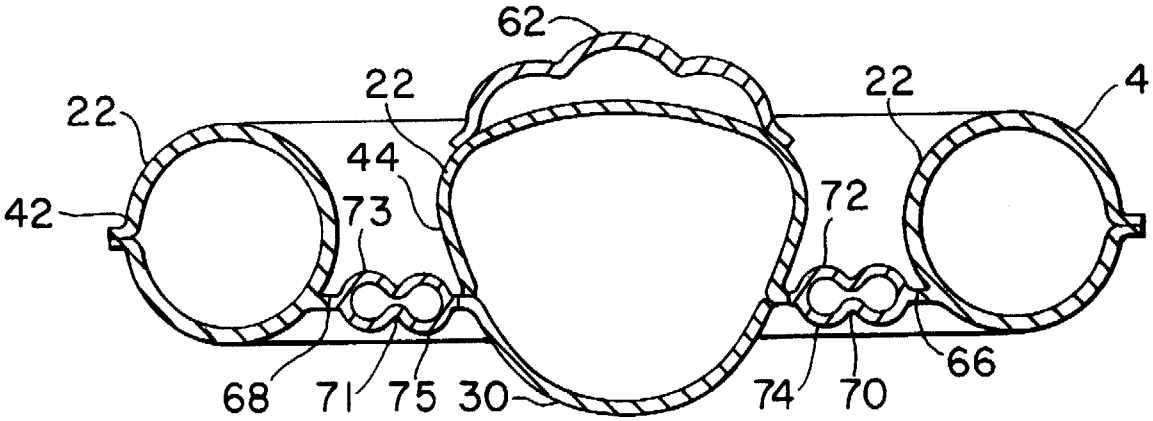
FIG. 8 is a cross-sectional view of the invention of FIG. 1, taken along the sectional line 8—8 in FIG. 3.

As best shown in FIGS. 3, 4, and 8, additional structural rigidity is supplied to the craft 20 by a left side foot inflation chamber complex 66 and a right side foot inflation chamber complex 68. Each foot inflation chamber complex 66, 68 includes a inflation chamber 70, 71 with a top portion 72, 73 and a bottom portion 74, 75. The top portion 72, 73 and the bottom portion 74, 75 of each foot inflation chamber 70, 71 are joined partially along the length of each foot inflation chamber 70, 71. Each of these chambers 70, 71 has an inflation valve 76, 77.

A left foot well 78 is formed by attaching the perimeter of the left foot inflation chamber complex 66 to: the middle chamber 44 of the aft portion 34 of the body 22, the left integrated perimeter inflation chamber 40, the stern 38, and the fore portion 32 of the upper surface 28. A right foot well 80 is formed by attaching the perimeter of the right foot inflation chamber complex 68 to: the middle chamber 44 of the aft portion 34 of the body 22, the right integrated perimeter inflation chamber 42, the stern 38, and the fore portion 32 of the upper surface 28.

When inflated, the foot inflation chamber complexes 66, 68 add rigidity to the craft 20 so as to prevent the aft portion 34 of the body 22 from "hooking" or achieving negative lift in excess of buoyancy while under tow. Additionally, the foot inflation chamber complexes 66, 68 provide a secure, padded region for a passenger to place feet and lower legs, thereby adding to the maneuverability of the vehicle. Additionally, the location of the foot wells allows for placement of a significant portion of a rider's body mass in a low portion of the vehicle, thereby increasing maneuverability and decreasing instability, particularly while cornering.

Figure 6:
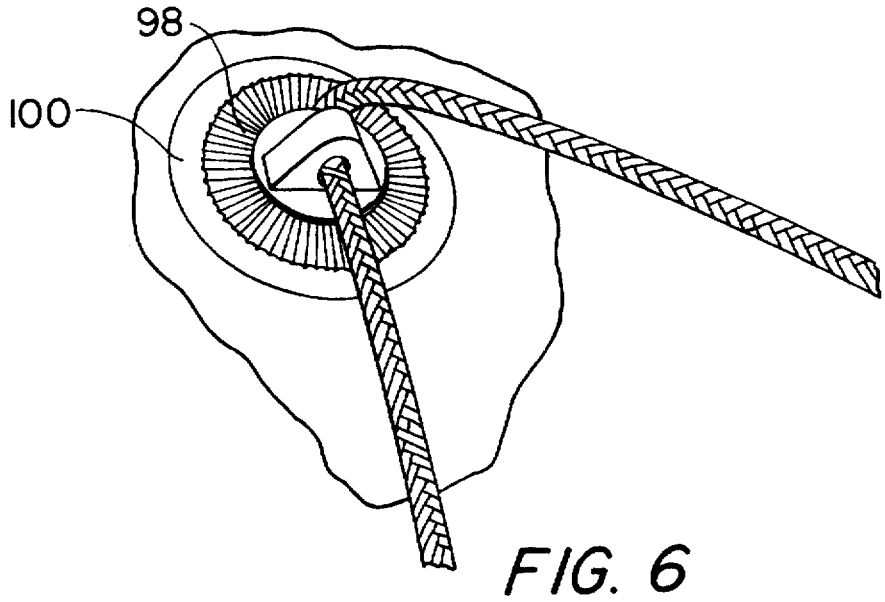
FIG. 6 is a partial perspective view of the invention of FIG. 1 showing rope tie detail.

As can be best shown in FIGS. 3 and 4, in order to provide forward motion to the towed water craft 20, four upper rope connector assemblies 89, 90, 91, 92 are attached to the fore portion 32 of the upper surface 28 of the body 22, with two of the upper rope connector assemblies 90, 91 mounted towards the fore of the fore portion 32 of the craft 20 and the other two of the upper rope connector assemblies 89, 92 mounted toward the rear of the cowling 24, and four lower rope connector assemblies 93, 94, 95, 96 are attached to the hull 26, with two of the lower rope connector assemblies 93, 95 mounted towards the fore of the fore portion 32 of the craft 20 and two of the lower rope connector assemblies 94, 96 mounted approximately amidships. As best shown in FIG. 6, each rope connector assembly 89, 90, 91, 92, 93, 94, 95, 96 includes a rope connector-mounting base 98 attached to a reinforcing element 100 which is in turn attached to the body 22 or the hull 26, as the case may be. An upper rope 102 is passed through the two fore-mounted upper rope connector assemblies 90, 91 and tied off at the aft-mounted upper rope connector assemblies 89, 92. A lower rope 104 of length shorter than the upper rope 102 is passed through the two fore-mounted lower rope connector assemblies 93, 95 and tied off at the aft-mounted lower rope connector assemblies 94, 96. The craft 20 is thus towable by attaching a tow line to both the upper and lower ropes 102, 104. Since the lower rope 104 is shorter in length than the upper rope 102, the pitch at which the craft 20 meets oncoming water is increased, thereby increasing low-speed planing.

In use, the body 22 of the device 20 is inflated with air through the body inflation valve 46, the cowling 24 is inflated through the cowling inflation valve 52, the seat 62 is inflated through the seat inflation valve 64, the left side foot inflation chamber 70 is inflated through the left side foot inflation chamber inflation valve 76, the right side foot inflation chamber 71 is inflated through the right side foot inflation chamber inflation valve 77. The body 22 is attached to a towing vehicle at the upper rope 102 and the lower rope 104. A passenger mounts the craft 20, placing a foot in the left foot well 78 and on top of the left side foot inflation chamber complex 66. The passenger places another foot in the right foot well 80 and on top of the right side foot inflation chamber complex 68. The passenger then may sit on the seat 62. The craft 20 is then towable by attaching a tow line to both the upper and lower ropes 102, 104.

It thus is seen that inflatable recreational vehicles designed to be towed behind motorized vehicles such as mountable, towed water craft can be both structurally stable at high speeds and be maneuverable while achieving low speed planing and resistance to diving upon capsizing while under tow. It should be understood that the described embodiments merely illustrate principles of the invention in preferred forms. Those skilled in the art will recognize many modifications, additions and deletions that may be made without undue experimentation and departure from the description provided.

What is claimed is:

1. An inflatable water craft comprising:

(a) a single chambered inflatable body comprising a hull and an upper surface attached to the hull, said body having a fore portion and an aft portion, said fore portion having a top portion, said body forming a first and a second foot well, thereby forming in the aft portion of the inflatable body a middle portion and a first outer portion and a second outer portion, said middle portion having a top portion; and (b) a cowling comprising an inflatable chamber attached to the top of the fore portion of the upper surface.

2. An inflatable water craft as recited in claim 1, further comprising: a first foot pad and a second food pad, said foot pads comprising a first inflatable chamber having a perimeter portion, the perimeter portion of the first inflatable chamber attached to the first foot well; and a second inflatable chamber having a perimeter portion, the perimeter portion of the second inflatable chamber attached to the second foot well.

3. An inflatable water craft as recited in claim 1 further comprising a seat comprising an inflatable chamber having a bottom portion, said bottom portion attached to the top portion of the middle portion of the inflatable body.

4. An inflatable water craft as recited in claim 1 further comprising one or more handles reinforceably attached to the cowling.

5. An inflatable water craft as recited in claim 1 wherein the hull comprises a means for increasing the pitch of the water craft.

6. An inflatable water craft as recited in claim 5 wherein the pitch increasing means is a longitudinally centered bulge formed in the hull.

7. An inflatable water craft as recited in claim 5 wherein the pitch increasing means is a means for towing the water craft.

8. An inflatable water craft as recited in claim 7 wherein the means for towing comprises:

(a) a first rope connector and a second rope connector reinforceably attached to the top portion of the fore portion of the inflatable body;

(b) a third rope connector and a fourth rope connector reinforceably attached to the hull;

(c) a first rope having a first end and a second end, said first end of said first rope attached to the first rope connector, said second end of said first rope end attached to the second rope connector;

(d) a second rope having length shorter than that of the first rope, the second rope having a first end and a second end, said first end of said second rope attached to the third rope connector, said second end of said second rope attached to the fourth rope connector.

9. An inflatable water craft as recited in claim 1 further comprising an tear-resistant fabric shell enclosing the inflatable chambers.

10. An inflatable water craft comprising:

(a) a first, a second and a third substantially cylindrical inflatable chamber, each having a first end and a second end with each first end forming an opening and each second end forming an opening;

(b) a fourth substantially cylindrical inflatable chamber having a front, a first end, a middle portion and a second end, the first end forming an opening, the middle portion forming an opening and the second end forming an opening; the first end of the first chamber attached to the first end of the fourth chamber; the first end of the second chamber attached to the middle portion of the fourth chamber, the second chamber substantially parallel to the first chamber; and the first end of the third chamber attached to the second end of the fourth chamber, the third chamber substantially parallel to the second chamber;

(c) a fifth inflatable chamber comprising a bow, an aft portion, a dorsal surface and a ventral surface; the aft portion having a first portion, a middle portion and a second portion; the first portion forming an opening, the middle portion forming an opening and the second portion forming an opening; the second end of the first chamber attached to the first end of the fifth chamber; the second end of the second chamber attached to the middle portion of the fifth chamber; and the second end of the third chamber attached to the second end of the fifth chamber; and (d) a sixth inflatable chamber forming a cowling having a bottom portion and a rear portion, the rear portion forming substantially a right angle with the bottom portion, and the bottom portion attached to the dorsal surface of the fifth inflatable chamber.

11. An inflatable water craft as recited in claim 10, further comprising:

(a) a first foot pad comprising a seventh inflatable chamber having a top portion, a bottom portion and a perimeter portion, the perimeter portion of the seventh chamber attached to the first chamber, the second chamber, the fourth chamber and the aft portion of the fifth chamber; and (b) a second foot pad comprising an eighth inflatable chamber having a perimeter portion, a top portion and a bottom portion, the perimeter portion of the eighth chamber attached to the second chamber, the third chamber, the fourth chamber and the fifth chamber.

12. An inflatable water craft as recited in claim 10 further comprising a passenger height adjusting means attached to the top portion of the second chamber.

13. An inflatable water craft as recited in claim 12 wherein the passenger height adjusting means comprises a seat comprising an inflatable chamber having a bottom portion, said bottom portion attached to the top portion of the second chamber.

14. An inflatable water craft as recited in claim 10 further comprising one or more handles reinforceably attached to the sixth chamber.

15. An inflatable water craft as recited in claim 10 wherein the fifth chamber comprises a means for increasing the pitch of the water craft.

16. An inflatable water craft as recited in claim 15 wherein the pitch increasing means is a longitudinally centered bulge formed in the ventral surface of the fifth chamber.

17. An inflatable water craft as recited in claim 15 wherein the pitch increasing means is a means for towing the water craft.

18. An inflatable water craft as recited in claim 17 wherein the means for towing comprises:

(a) a first rope connector and a second rope connector reinforceably attached to the dorsal surface of the fifth chamber;

(b) a third rope connector and a fourth rope connector reinforceably attached to the ventral surface of the fifth chamber;

(c) a first rope having a first end and a second end, said first end of said first rope attached to the first rope connector, said second end of said first rope end attached to the second rope connector;

(d) a second rope having length shorter than that of the first rope, the second rope having a first end and a second end, said first end of said second rope attached to the third rope connector, said second end of said second rope attached to the fourth rope connector.

19. An inflatable water craft as recited in claim 10 further comprising an tear-resistant fabric shell enclosing the inflatable chambers.

* * * * *